United States Patent [19]

Ellis et al.

[11] Patent Number: 4,486,329

[45] Date of Patent: Dec. 4, 1984

[54] LIQUID ALL-PURPOSE CLEANER

[75] Inventors: Roger D. Ellis, Ramsbottom, England; Yvon Demangeon, Embourg; Alain Jacques, Blegny, both of Belgium

[73] Assignee: Colgate-Palmolive Company, New York, N.Y.

[21] Appl. No.: 542,620

[22] Filed: Oct. 17, 1983

[51] Int. Cl.[3] ..... C11D 1/831; C11D 9/30

[52] U.S. Cl. ..... 252/117; 252/545; 252/546; 252/548; 252/559; 252/DIG. 14; 252/558

[58] Field of Search ..... 252/117, 121, 545, 546, 252/548, 551, 558, 559, DIG. 14

[56] References Cited

U.S. PATENT DOCUMENTS

| | | | |
|---|---|---|---|
| 2,220,099 | 11/1940 | Guenther et al. | 260/505 |
| 2,477,383 | 7/1949 | Lewis | 252/534 |
| 2,560,839 | 7/1951 | Ayo et al. | 252/109 |
| 3,234,138 | 2/1966 | Carroll et al. | 252/110 |
| 3,320,174 | 5/1967 | Rubinfeld | 252/539 |
| 3,350,319 | 10/1967 | Schonfeldt | 252/532 |
| 3,494,870 | 2/1970 | Kersnar et al. | 252/545 |
| 3,663,445 | 5/1972 | Augustin et al. | 252/117 |
| 3,694,648 | 9/1972 | Hentschel | 252/174.19 |
| 3,709,825 | 1/1973 | Chirash et al. | 252/158 |
| 3,856,711 | 12/1974 | Mausner et al. | 252/545 |
| 3,935,130 | 1/1976 | Hirano et al. | 252/542 |
| 4,017,409 | 4/1977 | Demessemaekers et al. | 252/109 |
| 4,056,113 | 11/1977 | Johnson et al. | 134/40 |
| 4,244,840 | 1/1981 | Straw | 252/540 |
| 4,412,943 | 11/1983 | Hirota et al. | 252/546 |

FOREIGN PATENT DOCUMENTS

| | | |
|---|---|---|
| 34564 | 11/1975 | Japan . |
| 1223739 | 3/1971 | United Kingdom . |

*Primary Examiner*—Prince E. Willis

*Attorney, Agent, or Firm*—Richard N. Miller; Murray M. Grill; Herbert S. Sylvester

[57] ABSTRACT

A clear, single phase, liquid cleaning composition particularly suitable for cleaning hard surfaces which leaves a low residue on unrinsed, cleaned surfaces consisting essentially of, by weight, 2–8% of an amine salt of an anionic sulfated or sulfonated detergent containing an alkyl radical of 8 to 22 carbon atoms in the molecule, 1–4% of water-soluble, ethyleneoxylated nonionic detergent, 2–15% of an amine salt of $C_1$–$C_3$ monocarboxylic acid builder, 0.1%–4% of amine, 0–2% of an amine salt of a $C_8$–$C_{18}$ carboxylic acid, 0–8% of urea and water, the weight ratio of builder to total detergent being in the range of 1:6 to 5:1 and said amine being selected from the group consisting of mono-, di- and tri-ethanol amine and etheylene diamine. Preferred compositions contain either the diethanolamine salts or the 2-aminoethylammonium salts.

12 Claims, No Drawings

LIQUID ALL-PURPOSE CLEANER

BACKGROUND OF THE INVENTION

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839, 3,234,138, 3,350,319, and British Pat. No. 1,223,739.

More recently, in view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalents tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquids, U.S. Pat. No. 4,017,409 teaches that a mixture of paraffin sulfonate and a reduced concentration of inorganic phosphate builder salt should be employed. However, such compositions are not completely acceptable from an environmental point of view based upon its phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

This invention relates to an improved all-purpose liquid cleaner designed in particular for cleaning hard surfaces which is effective in removing grease soil and in leaving unrinsed surfaces with a shiny appearance.

SUMMARY OF THE INVENTION

The present invention provides an improved, clear, single-phase, liquid, cleaning composition which is suitable for cleaning hard surfaces such as plastic, vitreous and metal surfaces having a shiny finish. More particularly, the improved cleansing compositions exhibit good grease soil removal properties and leave the cleaned surfaces shiny without the need of additional rinsing or wiping. The latter characteristic is evidenced by little or no visible residues on the unrinsed cleaned surfaces and, accordingly, overcomes the disadvantages of the prior art products.

In general, the improved all-purpose liquid cleaning compositions comprise an aqueous mixture of an amine salt of a water-soluble anionic detergent, a nonionic detergent and an amine salt of a $C_1$–$C_3$ monocarboxylic acid. Such compositions exhibit cleaning parity with competitive all-purpose liquid cleaners, but leave less residue on unrinsed surfaces when used full strength, i.e., undiluted, or at usual cleaning concentrations of 0.1–2% by weight of product in water. Thus, the improved all-purpose liquids leave washed surfaces with a better shine and at the same time provide a product which is easlier to color and to perfume.

More particularly, the improved, all-purpose, liquid detergent compositions of this invention consist essentially of, by weight, (A) 2% to 8% of a water-soluble ethanolamine or ethylene diamine salt of an anionic sulfated or sulfonated detergent salt containing an alkyl radical of 8 to 22 carbon atoms in the molecule; (B) 1% to 4% of a water-soluble ethyleneoxylated nonionic detergent selected from the group consisting of condensates of a $C_8$–$C_{18}$ alkanol with 2 to 15 moles of ethylene oxide, condensates of $C_6$–$C_{12}$ alkylphenol with 5 to 30 moles of ethylene oxide and condensates of $C_{10}$–$C_{16}$ alkanol with a heteric mixture of ethylene oxide and propylene oxide in a weight ratio of 2.5:1 to 4:1 with the total alkylene oxide content being 60% to 85% by weight, the weight ratio of said anionic detergent to nonionic detergent being from 0.5:1 to 5:1; (C) 2% to 15% of a water-soluble ethanolamine or ethylene diamine salt of a $C_1$–$C_3$ monocarboxylic acid as a builder salt, the weight ratio of builder salt to total detergent being in the range of 1:6 to 5:1; (D) 0.1% to 4% of ethanolamine or ethylene diamine; (E) 0–2% of a water-soluble ethanolamine or ethylene diamine salt of $C_8$–$C_{18}$ carboxylic acid; (F) 0–8% of urea; and (G) water.

Preferred all-purpose liquid detergent compositions consist essentially of, by weight, (A) 3.5% to 7% of a water-soluble ethanolamine or ethylene diamine salt of a $C_8$–$C_{16}$ alkylbenzene sulfonic acid; (B) 2% to 3% of a water-soluble condensate of a $C_8$–$C_{18}$ alkanol with 2 to 15 moles of ethylene oxide, the weight ratio of alkylbenzene sulfonate to nonionic detergent being from 1.2:1 to 3.5:1; (C) 4% to 10% of a water-soluble ethanolamine or ethylene diamine salt of a $C_1$–$C_3$ monocarboxylic acid; (D) 0.2% to 3% of ethanolamine or ethylene diamine; (E) 0.5% to 1.5% of a water-soluble ethanolamine or ethylene diamine salt of $C_8$–$C_{18}$ carboxylic acid; (F) 1% to 6% urea; and (G) water, the weight ratio of builder salt to total detergent (including soap) being in the range of 0.35:1 to 1.7:1.

DETAILED DESCRIPTION OF THE INVENTION

The clear, single-phase, all-purpose liquid detergents of this invention consist essentially of specific proportions of four components, namely, a water-soluble, ethanolamine or ethylene diamine salt of an anionic sulfated or sulfonated detergent salt containing an alkyl radical of 8 to 22 carbon atoms in the alkyl radical; a water-soluble ethyleneoxylated nonionic detergent; a water-soluble ethanolamine or ethylene diamine salt of a $C_1$–$C_3$ monocarboxylic acid; and water. Optional components include free ethanolamine or ethylene diamine, an ethanolamine or ethylene diamine salt of a $C_8$–$C_{18}$ carboxylic acid and urea.

The suitable anionic detergent salts employed in the liquid detergents are well known and can be broadly described as amine salts, e.g., ethylene diamine and the mono-, di- or tri-ethanolamine salts, of organic sulfuric reaction products having in their molecular structure an alkyl radical of 8 to 22 carbon atoms and a water-solubilizing radical selected from sulfuric acid and sulfonic acid radicals. Illustrative examples of water-soluble synthetic anionic detergents are ethanolamine or ethylene diamine salts of alkyl sulfates, especially those obtained by sulfating the $C_8$–$C_{18}$ alkanols produced by reducing the glycerides of tallow or coconut oil; ethanolamine or ethylene diamine alkyl benzene sulfonates in which the alkyl group contains from 8 to 16 carbon atoms, especially those of the type described in U.S. Pat. Nos. 2,220,099 and 2,477,383; ethanolamine or ethylene diamine alkyl glyceryl ether sulfates, especially those ethers of the $C_8$–$C_{18}$ alcohols derived from tallow and coconut oil; ethanolamine or ethylene diamine $C_8$–$C_{18}$ fatty acid monoglyceride sulfates; ethanolamine or ethylene diamine salts of sulfuric acid esters of the reaction product of one more of a $C_8$–$C_{18}$ fatty alkanol and about one to twelve, preferably one to five, moles of ethylene oxide; ethanolamine or ethylene diamine salts of $C_{10}$–$C_{20}$ alkane sulfonates; ethanolamine or ethylene diamine salts of $C_{12}$–$C_{21}$ alkene sulfonates and ethanolamine or ethylene diamine salts of the reaction product of $C_8$–$C_{18}$ fatty acids esterified with isethionic acid and neutralized with sodium hydroxide where, for example, the fatty acids are derived from coconut oil.

The preferred water-soluble synthetic anionic detergents are the 2-aminoethylammonium and the mono-, di- and triethanolammonium salts of $C_8$–$C_{16}$ alkyl benzene sulfonates and mixtures thereof with corresponding salts of $C_{12}$–$C_{21}$ olefin sulfonates or $C_8$–$C_{18}$ alkyl sulfates. A particularly suitable alkyl benzene sulfonate contains from 9 to 14 carbon atoms in the alkyl group in a straight chain with an alkyl distribution of 13–19% $C_9$, 15–25% $C_{10}$, 15–25% $C_{11}$, 15–25% $C_{12}$, 19% $C_{13}$ and 8% maximum of $C_{14}$. Another good alkylbenzene sulfonate is a linear alkyl benzene sulfonate having a high content of 3 (or higher) phenyl isomers and a correspondingly low content (well below 50%) of 2 (or lower) phenyl isomers; in other terminology the benzene ring is preferably attached in large part at the 3 or higher (e.g., 4, 5, 6 or 7) position of the alkyl group is attached at the 2 or 1 position is correspondingly low. The latter sulfonates are described in U.S. Pat. No. 3,320,174.

The water-soluble, amine salt of the anionic sulfonated or sulfated detergent is usually employed in concentrations of 2% to 8% by weight of the composition, with proportions in the range of 3.5 to 7% by weight being preferred. While any of the 2-aminoethylamine, monoethanolamine, diethanolamine and triethanolamine salts are satisfactory, the 2-aminoethylammonium and the diethanolammonium salts are generally preferred.

The nonionic synthetic organic detergents which are employed in the described compositions are generally the condensation product of an organic aliphatic or alkyl aromatic hydrophobic compound containing a terminal hydroxy group and hydrophilic ethylene oxide groups. Such detergents are prepared readily by condensing the hydrophobic organic compound with ethylene oxide or with the polyhydration product thereof, polyethylene glycol. Further, the length of the polyethenoxy chain can be adjusted to achieve the desired balance between the hydrophobic and hydrophilic elements.

The satisfactory nonionic detergents include the condensation products of a higher alkanol containing about 8 to 18 carbon atoms in a straight- or branched-chain configuration condensed with about 5 to 30 moles of ethylene oxide. Examples of these detergents are the condensates of a dodecyl, tridecyl, tetradecyl, hexadecyl alkanol and mixtures thereof with from three to ten moles of ethylene oxide, e.g., condensates of $C_9$–$C_{11}$ alkanol with 5.7 moles of ethylene oxide, condensates of $C_8$–$C_{10}$ alkanol with 5 moles of ethylene oxide and condensates of $C_{10}$–$C_{14}$ alkanol with 6 moles of ethylene oxide.

Other satisfactory nonionic detergents are the polyethylene oxide condensates of one mole of alkyl phenol containing from about 6 to 15 carbon atoms in a straight- or branched-chain configuration with about 5 to 30 moles of ethylene oxide. Specific examples are nonyl phenol condensed with 9 moles of ethylene oxide, nonyl phenol condensed with 12 moles of ethylene oxide, dodecyl phenol condensed with 15 moles of ethylene oxide and dinonyl phenol condensed with 15 moles of ethylene oxide. Further suitable detergents are the water-soluble condensation products of $C_{10}$–$C_{16}$ alkanols with a heteric mixture of ethylene oxide and propylene oxide in a weight ratio of ethylene oxide to propylene oxide in the range of 5:1 to 1:5 with the total alkylene oxide content being 60–85% by weight of the molecule. Specific examples of such detergents are $C_9$–$C_{11}$ alkanol condensed with a mixture of 5 moles of ethylene oxide and 4 moles of propylene oxide, $C_9$–$C_{11}$ alkanol condensed with 3 moles of ethylene oxide and 2 moles of propylene oxide and the condensation product of $C_9$–$C_{11}$ alkanol with a mixture of 4 moles of ethylene oxide and 5 moles of propylene oxide.

Generally, the proportion of the nonionic detergent which is used in the all-purpose liquid composition will be in the range of 1% to 4%, preferably 2% to 3%, by weight. For example, less than 1% by weight results in a product having poor grease soil removal ability. Further, the proportion of the nonionic detergent is controlled relative to the anionic detergent so that the weight ratio of anionic detergent to nonionic detergent will be from 0.5:1 to 6:1, preferably from 1.2:1 to 3.5:1. Such mixtures have been found to exhibit balanced cleaning and foaming properties.

The third essential component of the improved all-purpose liquid compositions is the water-soluble 2-aminoethylamine salt or ethanolamine salt of a $C_1$–$C_3$ monocarboxylic acid. Such organic acid salts are included to enhance the cleaning action of the organic detergents in these all-purpose liquids and to maintain the pH of such products in the alkaline range. Examples of suitable organic salts are 2-aminoethylammonium acetate, diethanolammonium acetate, diethanolammonium propionate, monoethanolammonium formate, triethanolammonium acetate, triethanolammonium acetate, triethanolammonium formate and 2-aminoethylammonium propionate. The 2-aminoethylammonium acetate and the diethanolammonium acetate are preferred salts because of their ready availability and their good performance. Depending upon the final product pH, the alkanolammonium salt may be present either in partially neutralized form or fully neutralized form; whereas, normally the 2-aminoethylamine salt is present as the 2-aminoethylammonium salt rather than the ethylene diammonium salt due to the presence of excess ethylene diamine. Furthermore, such salts may be incorporated in the resultant product in their salt form or may be formed in situ when added as acids which are subsequently neutralized by addition of either the appropriate ethanolamine or ethylene diamine.

The concentration of the water-soluble, amine, organic acid salt in the all-purpose liquid detergent generally will not exceed 15% by weight, with the minimum concentration being 2% by weight. Preferably, said salt will be present in amounts by 4% to 10% of the weight of the total composition, with the most preferred concentration being 6% by weight. Furthermore, the proportion of the $C_1$–$C_3$ organic acid salt is selected so that the weight ratio of organic acid builder salt to the total detergent is from 1:6 to 5:1, preferably from 0.7:1.0 to 3.6:1.0 in order that the balanced cleaning and the desired physical characteristics are achieved.

The remaining essential component is water, and this component usually represents the balance of the all-purpose liquid unless other optional ingredients are included.

In addition to the foregoing essential ingredients, in the preferred embodiment of this invention, the amine compound, i.e., mono-, di-, or triethanolamine or ethylene diamine, corresponding to the anion portion of the anionic detergents and organic builder will be present. More specifically, when the anionic detergent, e.g., the dodecylbenzene sulfonate, and the organic builder are added in acid form, usually the neutralization will be carried out using an excess of amine beyond the amount needed for complete neutralization. Such excess amine serves as a buffering agent to maintain the pH of the composition in the range of 7.5 to 11.0, preferably in the range of 8.5 to 10.0, and is believed to contribute to detergency performance. Typically, the excess amine, i.e., the free amine, will be in the range from 0.1% to 4%, with the preferred amounts being from 0.2% to 1.5% for the ethanolamine and from about 1% to 3% for ethylene diamine. Of course, when the composition is manufactured using the detergent and builder in the form of neutralized salts, the free amine may be added in order to adjust the pH of the composition to the desired value in the pH range of from 7.5 to 11.

Although ethylene diamine is capable of neutralizing two moles of monovalent acid, e.g., COOH and $SO_3H$, usually the mole ratio of ethylene diamine to the sum of the moles of anionic detergent and organic builder in acid form exceeds 1:1. Under these circumstances, the fully neutralized detergent and builder salt may be described as 2-aminoethylammonium salts. However, where the molar ratio of amine to acid form organic compounds is 0.5:1, the resultant salts could be described as ethylene diammonio salts. Of course, for mole ratios of amine to organic acid in the range of 0.5:1 to 1:1, the resultant salts would be a mixture of ethylene diammonio salts and 2-aminoethylammonio salts.

An important characteristic of the described all-purpose liquids is that both the anionic detergent and the builder salt are present in the form of amine salts. Surprisingly, when all-purpose liquid detergents containing such salts are diluted to use concentrations and used for cleaning, the washed, but unrinsed surfaces exhibit low amounts of visible residue and an enhanced shine. While the reason for the improved results is not completely understood, it is believed that the amine salts are less crystalline in nature than the corresponding sodium or potassium salts and, thus, leave a lower amount of visible residue on drying.

An additional advantage of the subject compositions is that they do not contain phosphate builder. Thus, they are more acceptable from an environmental standpoint. Furthermore, the fact that the cleaning performance of the resultant liquids has been maintained despite the omission of phosphate and other sodium or potassium inorganic builders also is surprising. Certainly such results would not have been expected based upon the prior art.

Optionally, up to 2% by weight of an amine salt of a $C_8$–$C_{18}$ alkanoic acid and up to 8% by weight of urea may be included in the all-purpose liquid compositions. The amine, i.e., the mono-, di- or triethanolammonium or 2-aminoethylammonium, salt provides desirable foaming properties, particularly rapid foam collapse when present; and the preferred proportions are 0.5% to 1.5% by weight. When the amine alkanoic acid salt is present, such salt is included as a detergent in determining the weight ratio of builder salt to the total detergent. On the other hand, urea provides improved low temperature stability by reducing the clear point of the all-purpose liquid. The preferred concentration of urea is 1% to 6% by weight.

A third optional component is ammonia which is usually added as aqueous ammonia or ammonium hydroxide. This ingredient provides a desirable ammonia odor in the product and appears to enhance the removal of grease soil. When present, the concentration of ammonia in the all-purpose liquid usually ranges from about 0.1% to 0.5%, preferably 0.15% to 0.25%, by weight.

The all-purpose liquid according to this invention may, if desired, also contain other components either to provide additional effect or to make the product more attractive to the consumer. The following are mentioned by way of example. Up to 1% by weight of perfumes, colors or dyes, opacifiers, bactericides and tarnish inhibitors such as benzotriazole may be added. Further, up to about 5% by weight of an organic solvent such as ethanol, ethylene glycol, propylene glycol and $C_1$–$C_4$ alkyl ethers of ethylene glycol may be included for control of viscosity or special solvent effects. Similarly, up to 5% by weight of a $C_1$–$C_3$ alkylbenzene sulfonate hydrotropic amine salt may be included for viscosity control provided such salt does not result either in increased residue or reduced shine on surfaces cleaned with the all-purpose liquid. Additionally, supplemental water-soluble amine salts of inorganic builder, preferably non-phosphate salts, such as bicarbonates, carbonates and silicates, may be included in amounts up to about 5% by weight to provide enhanced building action or for pH control. Finally, up to about 1–2% of a sodium or potassium chloride may be incorporated if an opacified product is desired.

In final form, the all-purpose liquids are clear and homogeneous and exhibit stability at reduced and increased temperatures. More specifically, such compositions exhibit clear points in the range of 0° C. to 50° C. and generally do not cloud below about 65° C. when heated. Such compositions exhibit a pH in the range of 7.5 to 11.0, preferably 8.5 to 10.0. The liquids are readily pourable and exhibit a viscosity in the range of 6 to 60 centipoises (cps.) as measured at 23° C. with a Brookfield RVT Viscometer using a #1 spindle rotating at 20 RPM. Preferably, the viscosity is maintained in the range of 20 to 60 cps.

Typically, the inventive compositions are manufactured in an agitated mixing vessel optionally equipped with a heating and/or cooling jacket. When the detergents and organic carboxylate builder are added in their amine salt form, the formula weight of the anionic sulfonated or sulfated detergent salt is added to and dissolved in the formula weight of water which is preferably deionized water using moderate agitation. Agitation is continued and the nonionic detergent and the amine $C_1$–$C_3$ monocarboxylate are added. The pH is adjusted to a pH in the range of 8.5 to 10 using either free amine or free monocarboxylic acid as the case may be. In this pH range, approximately at least about 0.2% by weight of the appropriate amine is present. Thereafter, optional ingredients such as urea, perfume, color and ammonium hydroxide are added with agitation. The resultant product is cooled to about 25° C. to 30° C. and filled into appropriate containers.

When the subject product is prepared by forming the anionic amine detergent salt and the amine monocarboxylic acid salt in situ, the order of addition is essentially the same with the exception that both the anionic detergent and the monocarboxylate builder are added in acid form and the formula weight of the appropriate amine is added after the addition of said $C_1$–$C_3$ monocarboxylic acid. Usually, amine addition is continued until the desired pH is attained.

The cleaning performance of the described liquid cleaning compositions is based upon grease soil removal. In the grease soil removal test, white vinyl tiles (15 cm.×15 cm.) are painted with a chloroform solution containing 5% cooking fat, 5% hardened tallow and a sufficient amount of activated carbon to render the film visible. After permitting the tiles to dry for one hour at room temperature, the tiles are mounted in a Gardner Washability Machine equipped with two cellulose sponges measuring 5 cm.×5 cm.×5 cm. Ten milliliters of a 10% solution of the liquid cleaning composition being tested is pipetted onto the sponge and the number of strokes required to remove the grease film is determined. Products are evaluated in pairs and usually six replications are run on each composition. Score differences are tested for significance using the Students T-test and a difference in performance of about 10% is significant at the 95% confidence level.

Residue on drying is determined using a streaking or filming test in which prior-cleaned, black, glazed tiles (10×10×0.8 cm) from which all possible residues have been removed are treated with a cleaning solution containing 1.1% by weight of the test composition. The hardness of the water used to prepare the cleaning solution may be varied as desired and is expressed as p.p.m. of calcium carbonate. Testing is done by applying 20 grams of cleaning solution to a sponge which is mechanically moved forward and backward over the surface of the black tile while being maintained at a uniform pressure of about 10 gm/cm$^2$ against said tile. A total of five forward and five backward strokes are applied, cleaning a path of about 7.5 cm on the tile. Thereafter, each tile is left to dry, and the tile is rated for residue or filming by two experienced graders under standard northern daylight against a tile treated in similar fashion with a comparative composition using the following scale: 0=no difference; +1=directionally superior; −1=directionally inferior; +2=superior; −2=inferior; +3=clearly superior; and −3=clearly inferior.

The following examples illustrate liquid cleaning compositions of the described invention. Unless otherwise specified, all percentages are by weight. The exemplified compositions are illustrative only and do not limit the scope of the invention.

EXAMPLE 1

A preferred, liquid, hard surface, cleaning composition follows:

| Ingredient | Percent |
|---|---|
| Diethanolamine salt of linear $C_9$–$C_{13}$ alkyl benzene sulfonic acid | 4.5 |
| Condensation product of 5.7 moles of ethylene oxide with $C_9$–$C_{11}$ alkanol | 2.0 |
| Diethanolamine coconut soap | 0.73 |
| Diethanolamine acetate | 6.0 |
| Urea | 4.0 |
| Free diethanolamine | 0.6 |
| Perfume | 0.4 |
| Water | balance |
| | 100.0 |

This composition is a clear liquid having a viscosity of 40 cps. at room temperature as measured by a Brookfield Viscometer, Model RVT, using a No. 1 spindle rotating at 20 rpm. Such composition has a clear point below 4° C. and remains stable after aging for three months at 4° C., 23° C. and 43° C.

The foregoing composition is prepared by disolving 3.5 parts of $C_9$–$C_{13}$ alkylbenzene sulfonic acid (96% alkylbenzene sulfonic acid, 2.5% (Max) sulfuric acid and 1.8% (Max) ether soluble) in the formula weight of water, i.e., 81.4 parts, with agitation. 0.5 parts by weight of $C_3$–$C_{18}$ fatty acids derived from coconut oil and 2.18 parts by weight of acetic acid are sequentially added to and dissolved in the aqueous sulfonic acid solution with agitation. Thereafter, 6 parts by weight of diethanolamine are added to the aqueous acidic mixture with agitation to neutralize the organic sulfonic acid, the carboxylic acid and the acetic acid to form the corresponding water-soluble diethanolamine salts. The amount of diethanolamine added provides about 0.6 parts by weight of free diethanolamine which is effective to achieve a pH in the final product of about 8.5. Finally, the formula amounts of urea and perfume are admixed with the resultant solution.

The cleaning properties of the composition of Example 1 were compared with three commercial all-purpose liquid cleaning products using the grease soil removal test and the results are set forth in Table A below. This evaluation was done by testing the products in pairs.

TABLE A

| | Gardner Abrader (No. of Strokes) | | | | | | |
|---|---|---|---|---|---|---|---|
| Product | 1 | 2 | 3 | 4 | 5 | 6 | Average |
| Example 1 | 26 | 24 | 28 | 30 | 24 | 22 | 26 |
| Commercial Product I* | 80 | 80 | 84 | 59 | 68 | 82 | 76 |
| Example 1 | 23 | 25 | 25 | 24 | 27 | 28 | 25 |
| Commercial Product II** | 43 | 35 | 46 | 37 | 46 | 39 | 41 |
| Example 1 | 25 | 29 | 26 | 31 | 34 | 29 | 29 |
| Commercial Product III*** | 25 | 21 | 17 | 31 | 34 | 21 | 25 |

*Product I contains by analysis 8% sodium paraffin sulfonate, 0.4% soap, 2.4% nonionic detergent, 5% potassium pyrophosphate and water.
**Product II contains 1.2% of sodium dodecylbenzene sulfonate, 0.2% soap, 7.3% nonionic detergent, 0.5% of trisodium nitrilotriacetate, 0.13% ammonia and water.
***Product III contains 3.5% of sodium dodecylbenzene sulfonate, 0.7% soap, 2% nonionic detergent, 4% sodium carbonate and 2.4% of sodium nitrilotriacetate.

The foregoing evaluations against commercial products show that the compositions of this invention are either equivalent or superior in cleaning effectiveness in removal of grease soils.

When the composition of Example 1 was compared with commercial Products I and III above for residue using the earlier described test for residue, the results were as shown in Table below:

TABLE B

| Grader | 1 vs I | 1 vs III |
|---|---|---|
| #1 | +2 | +3 |
| #2 | +2 | +3 |

EXAMPLE 2

The composition of Example 1 is repeated with the exception that the urea is omitted and is replaced by an equivalent weight of water. The resultant product has a pH of 8.5 and a viscosity of 40 cps. at room temperature. This composition represents an especially preferred embodiment.

EXAMPLE 3

The composition of Example 1 is repeated with the exception that the condensation product of nonyl phenol and 9 moles of ethylene oxide is substituted for the alkanol ethylene oxide condensate and 0.4% of aqueous ammonium hydroxide (60% $NH_4OH$) is added in place of a like percentage of water. The resultant composition has a pH of 9.4 and a viscosity of 52 cps. at room temperature. Further, it exhibits a desirable ammonia odor.

EXAMPLE 4

The composition of Example 1 is repeated with the exception that the soap is ommitted and is substituted by an equivalent percentage of water. The resultant composition has a pH of 8.7 (contains about 0.8% free diethanolamine) and a viscosity of 35 cps. at room temperature. Such product is effective in removal of grease soil and leaves a low residue on the cleaned substrate.

EXAMPLE 5

The composition of Example 4 is repeated with the exception that 2% of urea is omitted and is replaced with 2% of water. This composition exhibits a pH of 8.7 and a viscosity of 54 cps. at room temperature. Again, the product cleans effectively while leaving a low residue on the substrate cleaned.

EXAMPLE 6

Another satisfactory composition containing triethanolamine salts follows:

| Ingredient | Percent |
|---|---|
| Triethanolamine salt of linear $C_9$–$C_{13}$ alkylbenzene sulfonic acid | 4.9 |
| Condensation product of 5.7 moles of ethylene oxide with $C_9$–$C_{11}$ alkanol | 2.0 |
| Triethanolamine coconut soap | 0.9 |
| Triethanolamine acetate | 7.6 |
| Triethanolamine to pH 9.4 | q.s. |
| Perfume | 0.4 |
| Water | bal. |
| | 100.0 |

This product has a pH of 9.4 and a viscosity of 38 cps. at room temperature.

A comparison of the composition of Example 6 with the composition of Example 2 for cleaning effectiveness in the Grease Soil Removal Test gave the results shown in Table C.

TABLE C

| | Gardner Abradner Value (No. of Strokes) | | | | | | |
|---|---|---|---|---|---|---|---|
| Product | 1 | 2 | 3 | 4 | 5 | 6 | Average |
| Example 6 | 22 | 38 | 30 | 24 | 37 | 32 | 31 |
| Example 2 | 19 | 25 | 29 | 16 | 22 | 32 | 24 |

These results show that the composition containing diethanolamine salts is preferred for cleaning ability.

Examination of the cleaned substrates for visible residues indicated that the compositions of Examples 2 and 6 produced equivalent results, each being characterized by a low amount of visible residue.

EXAMPLE 7

Another suitable composition containing an increased proportion of builder salt follows:

| Ingredient | Percent |
|---|---|
| Diethanolamine salt of linear $C_9$–$C_{13}$ alkylbenzene sulfonic acid | 4.5 |
| Condensation product of 5.7 moles of ethylene oxide with $C_9$–$C_{11}$ alkanol | 2.0 |
| Diethanolamine coconut soap | 0.73 |
| Diethanolamine acetate | 10.0 |
| Urea | 4.0 |
| Perfume | 0.4 |
| Diethanolamine | 0.1 |
| Aqueous ammonium hydroxide (66% $NH_4OH$) | 0.4 |
| Water | balance |
| | 100.0 |

This product has a pH of 9.5 and a viscosity of 60 cps. at room temperature and is prepared according to the process of Example 1 wherein the anionic detergent, soap and organic builder are added in acid form and are neutralized by adding 8 parts of diethanolamine.

A comparison of this composition with the composition of Example 2 for cleaning effectiveness in the Grease Soil Removal Test yielded the results shown in Table D.

TABLE D

| | Gardner Abrader (No. of Strokes) | | | | | | |
|---|---|---|---|---|---|---|---|
| Product | 1 | 2 | 3 | 4 | 5 | 6 | Average |
| Example 7 | 21 | 42 | 44 | 26 | 29 | 39 | 34 |
| Example 2 | 18 | 32 | 22 | 19 | 28 | 25 | 24 |

These results show that an increased concentration of diethanolamine acetate did not result in increased grease soil removal. Again, examination of the cleaned substrates showed a low amount of visible residue, thereby indicating that the compositions of Example 2 and 7 produced equivalent results in this regard.

EXAMPLE 8

The composition of Example 1 is repeated with the exception that 2% by weight of a condensation product of a $C_9$–$C_{11}$ alkanol with a heteric mixture of four moles of ethylene oxide and five moles of propylene oxide is substituted for 2% of the condensate of $C_9$–$C_{11}$ alkanol and 5.7 moles of ethylene oxide. The resultant product is a clear liquid having a viscosity of 10 cps., clear point greater than 0° C. and a cloud point greater than 90° C.

EXAMPLES 9–13

The examples set forth in Table E below illustrate the effect of the concentration of the organic builder on the physical characteristics of the resultant product. Also shown is the effect of cleaning performance based upon a comparison of each composition with Product III described in Table A above. Such comparison is based upon the grease soil removal test. Six replications were run for each product and the results analyzed statistically using the Student T test. Although the statistical results indicated no significant cleaning differences based upon the concentration of organic builder, the actual T values are set forth to show that an increase in cleaning performance is noted as the concentration of organic builder salt increases. As Product III contains 6.4% by weight of detergent builder salt, the statistical results suggest that the organic builder salt is equivalent to the mixture of sodium carbonate and trisodium nitrilotriacetate in the commercial product.

TABLE E

| Ingredients | Percent by weight | | | | |
|---|---|---|---|---|---|
| | 9 | 10 | 11 | 12 | 13 |
| Diethanolamine salt of linear $C_9$–$C_{13}$ alkylbenzene sulfonic acid | 4.5 | 4.5 | 4.5 | 4.5 | 4.5 |
| Condensation product of 5.7 moles of ethylene oxide with one mole of $C_9$–$C_{11}$ alkanol | 2.0 | 2.0 | 2.0 | 2.0 | 2.0 |
| Diethanolamine coconut soap | 0.73 | 0.73 | 0.73 | 0.73 | 0.73 |
| Diethanolamine acetate | 2 | 4 | 6 | 8 | 10 |
| Urea | 4 | 4 | 4 | 4 | 4 |
| Diethanolamine | 0.6 | 0.6 | 0.6 | 0.6 | 0.6 |
| Water | bal. | bal. | bal. | bal. | bal. |
| | 100.0 | 100.0 | 100.0 | 100.0 | 100.0 |
| pH Total | 8.5 | 8.5 | 8.5 | 8.5 | 8.5 |
| Viscosity (cps.) | 8 | 13 | 23 | 28 | 28 |
| Cleaning performance T value vs. control | −3.2 | −3.6 | +1.8 | +0.3 | +0.1 |

Table E suggests 6% by weight of organic builder salt represents an optimum concentration for the subject composition.

EXAMPLES 14 AND 15

Other suitable all-purpose liquid detergents within the scope of the described invention follow:

| | 14 | 15 |
|---|---|---|
| Diethanolamine linear $C_9$–$C_{13}$ alkylbenzene sulfonate | 3 | 6 |
| $C_9$–$C_{11}$ alkanol.5.7 EtO | 1 | 1 |
| Diethanolamine coconut soap | 0.73 | 0.73 |
| Diethanolamine acetate | 6 | 6 |
| Urea | 4 | 4 |
| Diethanolamine | 1.2 | 0.4 |
| Water | bal. | bal. |
| Total | 100.0 | 100.0 |
| pH | 8.5 | 8.5 |
| Viscosity (cps.) | 8 | 40 |

The composition of Example 14 exhibits poorer grease soil removal than commercial Product III; whereas, the composition of Example 15 exhibits better cleaning than said commercial product.

EXAMPLES 16–20

Other preferred compositions based upon 2-aminoethylammonium acetate builder-sequestrant are set forth in Table F below. These compositions are prepared using the method of Example 1.

| Ingredients | Percent by weight | | | | |
|---|---|---|---|---|---|
| | 16 | 17 | 18 | 19 | 20 |
| 2-aminoethylammonio $C_9$–$C_{13}$ alkylbenzene sulfonate | 4.0 | 4.0 | 4.0 | 4.0 | 4.0 |
| 2-aminoethylammonio $C_8$–$C_{18}$ carboxylate | 0.65 | 0.65 | 0.65 | 0.65 | 0.65 |
| 2-aminoethylammonio acetate | 4.4 | 4.4 | 4.4 | 4.4 | 4.4 |
| $C_9$–$C_{11}$ alkanol.8 EtO | 2.0 | — | — | — | — |
| Nonylphenol.12 EtO | — | 2.0 | 2.0 | — | — |
| $C_{12}$–$C_{15}$ alkanol.5 EtO.4 .4 PrO | — | — | — | 2.0 | 2.0 |
| Water, perfume salts | bal. | bal. | bal. | bal | bal. |
| Total | 100.0 | 100.0 | 100.0 | 100.0 | 100.0 |
| pH | 9.3 | 9.4 | 9.8 | 9.9 | 11.0 |
| Viscosity (cps. @ 25° C.) | 30 | 55 | 40 | 25 | 30 |
| Mean strokes to clean | 43 | 21 | — | 50 | — |

The composition of Example 17 exhibits excellent grease soil removal properties. While the compositions of Examples 16 and 19 exhibit poorer cleaning efficiency, all of the foregoing compositions exhibit low residues when tested as described herein.

The invention has been described with respect to various examples and illustrations thereof but is not to be limited to these because it is clear that one of skill in the art, with the present description before him, will be able to utilize substitutes and equivalents without departing from the invention.

We claim:

1. A clear, single-phase, liquid cleaning composition particularly suitable for cleaning hard surfaces which leaves a slight visible residue on unrinsed, cleaned surfaces consisting essentially of, by weight, (A) 2% to 8% of a water-soluble mino-, di-, or triethanolamine or ethylene diamine salt of an anionic sulfated or sulfonated detergent containing an alkyl radical of 8 to 22 carbon atoms in the molecule; (B) 1% to 4% of a water-soluble alkyleneoxylated nonionic detergent selected from the group consisting of condensates of $C_8$–$C_{18}$ alkanol with 2 to 15 moles of ethylene oxide, condensates of $C_6$–$C_{12}$ alkylphenol with 5 to 30 moles of ethylene oxide and condensates of $C_{10}$–$C_{16}$ alkanol with a heteric mixture of ethylene oxide and propylene oxide in a weight ratio of 5:1 to 1:5 with the total alkylene oxide content being 60% to 85% by weight, the weight ratio of said sulfated or sulfonated detergent to nonionic detergent being from 0.5:1 to 6:1; 2% to 15% of a water-soluble mono-, di-, or tri-ethanolamine or ethylene diamine salt of a $C_1$–$C_3$ monocarboxylic acid builder, the weight ratio of builder to total detergent being in the range of 1:6 to 5:1; 0.1% to 4% by weight of mono-, di- or tri-ethanolamine or ethylene diamine; 0–2% of a water-soluble, mono-, di- or tri-ethanolamine or ethylene diamine salt of $C_8$–$C_{18}$ carboxylic acid; 0–8% of urea; and water.

2. A cleaning composition according to claim 1 wherein the builder is diethanolamine acetate or 2-aminoethylammonium acetate.

3. A cleaning composition according to claim 1 wherein 0.5% to 1.5% by weight of said carboxylic acid salt is present.

4. A cleaning composition according to claim 1 wherein from 1% to 6% by weight of urea is present.

5. A cleaning composition according to claim 1 wherein said anionic detergent is a salt of $C_9$–$C_{14}$ alkylbenzene sulfonic acid.

6. A cleaning composition according to claim 5 wherein said anionic detergent is the diethanolamine salt which is present in an amount of 3.5–7% by weight and said builder is present in the form of the diethanolamine salt in an amount of 4% to 10% by weight.

7. A cleaning composition according to claim 5 wherein said alkylbenzene sulfonic acid is present as the diethanolamine salt, said builder is diethanolamine acetate and which contains, in addition, 0.5% to 1.5% by weight of the diethanolamine salt of $C_8$–$C_{18}$ carboxylic acid.

8. A cleaning composition according to claim 7 wherein 1% to 6% by weight of urea is present.

9. A cleaning composition according to claim 7 wherein said nonionic detergent is said alkylphenol ethylene oxide condensate.

10. A cleaning composition according to claim 5 wherein said anionic detergent is the 2-aminoethylammonium salt, said builder is 2-aminoethylammonium acetate and which includes, in addition, 0.5% to 1.5% by weight of 2-aminoethylammonium $C_8$–$C_{18}$ carboxylate.

11. A cleaning composition according to claim 10 wherein said nonionic detergent is said alkylphenol ethylene oxide condensate.

12. A cleaning composition according to claim 1 which further includes in addition from 0.1% to 0.5% of ammonium hydroxide.

* * * * *